US008991005B2

(12) United States Patent
Mersmann

(10) Patent No.: US 8,991,005 B2
(45) Date of Patent: Mar. 31, 2015

(54) UPRIGHT VACUUM CLEANER

(71) Applicant: Miele & Cie KG, Guetersloh (DE)

(72) Inventor: Udo Mersmann, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 14/061,767

(22) Filed: Oct. 24, 2013

(65) Prior Publication Data

US 2014/0115817 A1 May 1, 2014

(30) Foreign Application Priority Data

Oct. 25, 2012 (DE) ..... 10 2012 110 182

(51) Int. Cl.
*A47L 9/00* (2006.01)
*A47L 5/34* (2006.01)
*A47L 5/28* (2006.01)

(52) U.S. Cl.
CPC ... *A47L 5/34* (2013.01); *A47L 5/28* (2013.01); *A47L 9/0009* (2013.01); *A47L 9/009* (2013.01)
USPC ..... 15/410; 15/354

(58) Field of Classification Search
USPC ..... 15/411, 354–356, 359–361, 410, 351
IPC ..... A47L 9/32
See application file for complete search history.

(56) References Cited

U.S. PATENT DOCUMENTS

| | | | | | |
|---|---|---|---|---|---|
| 2,300,204 | A | * | 10/1942 | Carison | 15/333 |
| 2,677,846 | A | * | 5/1954 | Segesman | 15/333 |
| 4,823,430 | A | * | 4/1989 | Yonkers et al. | 15/361 |
| 5,351,361 | A | * | 10/1994 | Buchtel | 15/334 |
| 6,588,051 | B2 | | 7/2003 | Hashizume et al. | |
| 8,281,456 | B2 | * | 10/2012 | Finke | 15/410 |
| 2008/0115313 | A1 | | 5/2008 | Dyson et al. | |
| 2009/0056065 | A1 | | 3/2009 | Finke | |
| 2009/0064450 | A1 | | 3/2009 | Newton et al. | |

FOREIGN PATENT DOCUMENTS

| | | | |
|---|---|---|---|
| DE | 60123688 | T2 | 8/2007 |
| DE | 102007040954 | A1 | 3/2009 |

* cited by examiner

*Primary Examiner* — Dung Van Nguyen
(74) *Attorney, Agent, or Firm* — Leydig, Voit & Mayer, Ltd.

(57) ABSTRACT

An upright-type vacuum cleaner includes an upper body pivotally connected to a base unit so as to be pivoted during vacuuming or substantially upright in a parked position. The base unit includes a front portion with a suction opening and is equipped with a carriage that allows the vacuum cleaner to be moved across surfaces being cleaned during a vacuuming operation. The carriage includes at least one main wheel disposed in a rear portion of the base unit. An adjusting mechanism is configured to move the main wheel from a first position during vacuuming to a second position in the parked position with the distance from the main wheel to the suction opening being greater in the second position. An actuating element formed on the upper body is configured to engage with a lever linkage assembly of the adjusting mechanism as the upper body is moved to the parked position.

12 Claims, 3 Drawing Sheets

UPRIGHT VACUUM CLEANER

CROSS REFERENCE TO RELATED APPLICATIONS

This application claims priority from German Patent Application No. DE 10 2012 110 182.5, filed Oct. 25, 2012, which is hereby incorporated by reference herein in its entirety

FIELD

The present invention relates to a vacuum cleaner of the upright type.

BACKGROUND

Vacuum cleaners of the aforementioned type have become established on the market. The basic design of these vacuum cleaners includes a base unit equipped with a carriage and an upper body pivotally connected to the base unit. During vacuuming, the upright can be flexibly maneuvered by pivoting and axially twisting the upper body. In a rest phase after completion or interruption of the vacuuming operation, the upper body can be moved to a vertical parked position, in which the main wheels on the base unit are at the same time pivoted rearward. In this manner, the footprint of the base unit is increased, allowing the upright to stand securely while not in use. German Patent Application DE 10 2007 040 954 A1 describes such an upright vacuum cleaner where the actuating mechanism for pivoting the main wheels to the parked position is made up of number of linked functional components. Among other things, an interposed gear mechanism is used here for the adjusting mechanism. While the actuating and adjusting mechanism proposed in this publication appears to properly perform the desired function, namely to move the main wheels to the parked position, the design and means chosen for this purpose appear to be complex and expensive. Moreover, a potential risk involved here is that the adjusting mechanism may be highly susceptible to failure due to the large number of individual components required and because of the use of a gear mechanism.

SUMMARY

In an embodiment, the present invention provides an upright-type vacuum cleaner includes an upper body and a base unit pivotally connected to the upper body. The base unit includes a front portion with a suction opening and is equipped with a carriage configured to allow the vacuum cleaner to be moved across surfaces to be cleaned during a vacuuming operation. The carriage includes at least one main wheel disposed in a rear portion of the base unit. A pivot mechanism is disposed between the upper body and the base unit. The pivot mechanism is configured to allow the upper body to be pivoted during the vacuuming operation and the upper body is movable to a substantially upright parked position. An adjusting mechanism is configured to move the main wheel from a first position during vacuuming to a second position in the parked position with the distance from the main wheel to the suction opening being greater in the second position than in the first position during vacuuming The adjusting mechanism includes a lever linkage assembly and an actuating element formed on the upper body is configured to engage with the lever linkage assembly as the upper body is moved to the parked position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
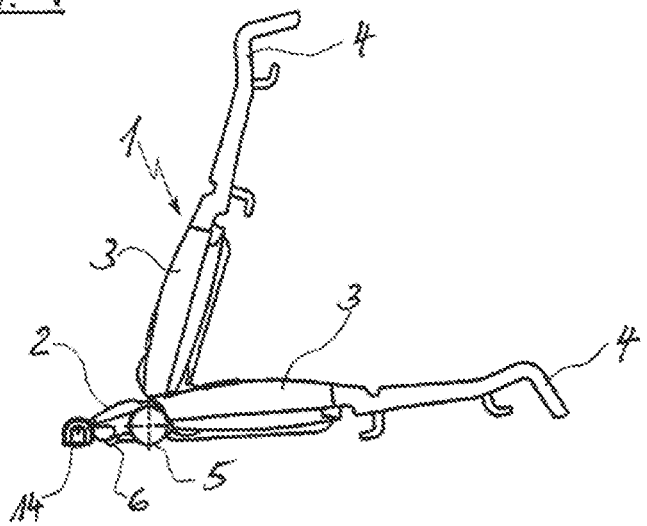
FIG. 1 is a simplified schematic side view showing an upright vacuum cleaner in two possible operating positions during the vacuuming operation, namely a position in which the upper body is upright and a position in which the upper body is maximally pivoted downwardly.

An aspect of the present invention is to provide an adjusting mechanism for displacing the main wheels mounted in the base unit of an upright vacuum cleaner of the type mentioned at the outset, which mechanism can be implemented with simple means.

A particular advantage provided by embodiments of the present invention is that the lever linkage assembly designed in accordance with the present invention provides a mechanism which is suitable for adjusting the main wheels and can be implemented using means that are simple and inexpensive to manufacture. Further, this allows for a simple design, which facilitates assembly during manufacture or in the event of repair. In addition, the lever linkage assembly proves to be very rugged and resistant to failure in everyday use, even when operated frequently.

In a suitable embodiment, the lever linkage assembly is connected to the main wheel which can be moved by the lever linkage assembly from a first position during vacuuming to a second position in the parked position. In the second position, the main wheel has a greater distance from the suction opening than in the first position during vacuuming. In this way, the footprint of the base unit is increased by means already mounted thereon, thereby improving the stability and vertical standing of the vacuum cleaner in the parked position.

In another embodiment, the lever linkage assembly includes a drive lever, a linking lever, and an adjusting lever. The drive lever is adapted to come into engagement with an actuating element of the upper body and is pivotally mounted at a bearing point of the base unit, so that the adjusting lever, which is connected to the main wheel or to an axle carrying a plurality of main wheels, is also pivotally mounted at a bearing point of the base unit. The drive lever and the adjusting lever are connected by a linking lever. In this manner, the aforedescribed means already provide a mechanism which is capable of increasing the footprint of the vacuum cleaner in the parked position.

In another embodiment, the drive lever and the adjusting lever are connected by the linking lever via respective pivoting joints. This facilitates particularly easy operation of the lever linkage assembly.

Moreover, the drive lever is designed as a two-armed lever having a first lever arm and a second lever arm and is mounted at a bearing point fixedly secured in the base unit such that it can pivot about a pivot axis located between the two lever arms. The first lever arm is oriented in such a way that it can be brought into engagement with the actuating element by a pivoting movement of the upper body, and that the lever arm is acted upon by a spring element in such a manner that the main wheel is held in the traveling position for the base unit during the vacuuming operation. This ensures that the vacuum cleaner can be maneuvered particularly easily during vacuuming.

In a suitable embodiment, the spring element is in the form of a torsion spring which is push-on mounted on a pin member at the bearing point of the base unit such that one arm of the torsion spring acts on the lever arm of the drive lever and the other spring arm acts on an attachment point formed in the base unit. In this way, it is achieved in a particularly simple manner that the main wheel is held in the traveling position for the base unit during the vacuuming operation.

Figure 2:
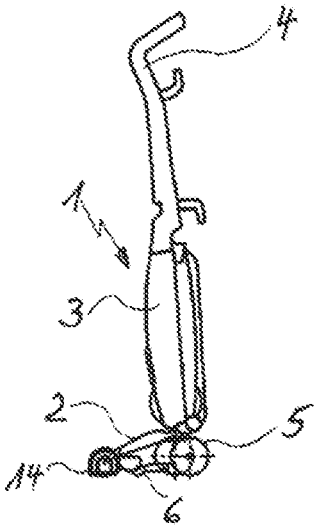
FIG. 2 is a simplified schematic side view showing the upright vacuum cleaner in its upright parked or rest position.

FIGS. 1 and 2 illustrate, in simplified form, an upright vacuum cleaner 1 (hereinafter merely called upright). These figures show only the basic parts of upright 1 and symbolically illustrate the tilted and standing positions of upright 1 that are essential for explaining the present invention. The upright 1 shown here by way of example includes a base unit 2 having two rear main wheels 5 and an upper body 3 having a handle 4 attached thereto. Small supporting or caster wheels 6 and suction opening 14 of a brush roller are indicated in the front portion of base unit 2. Using handle 4, upright 1 can be steered and maneuvered with its base unit 2 across the surface to be vacuumed. Moreover, handle 4 is typically provided with electrical controls (not specifically shown here) for operating the vacuum cleaner.

Base unit 2 and upper body 3 are connected by an articulation mechanism in the form of a combined tilt and swivel joint. By actuation of handle 4, upper body 3 can be tilted from 0° to 90°, as illustrated in FIGS. 1 and 2. During vacuuming, upper body 3 can also be axially rotated at the same time. The configuration with a tilt and swivel joint between base unit 2 and upper body 3 also allows base unit 2 to be steered along a curved path around obstacles and to be moved under furniture and into niches with upper body 3 in a lowered position.

In FIG. 1, upright 1 is shown in two possible operating positions during the vacuuming operation. In the upright position, base unit 2 and upper body 3 are at an angle of about 70° with respect to each other. This corresponds to the usual upright position during normal vacuuming operation. In the lowered, nearly horizontal position, the angle between base unit 2 and upper body 3 is approximately 0°. In this extremely flat position, base unit 2 can be moved under beds, cabinet base frames, and other furniture niches. Upper body 3 can be pivoted beyond the upright operating position of about 70° to 90° (FIG. 1) to the vertical parked or rest position shown in FIG. 2. In this process, an adjusting mechanism disposed between upper body 3 and main wheel 5 comes into action. The pivotal movement to the parked position activates the adjusting mechanism, causing main wheel 5 to be pivoted rearward by about 40°. This advantageously increases the footprint of upright 1, enabling it to stand securely and stably in this parked position. In contrast, during vacuuming, a short distance between the front supporting or caster wheels 6 and rear main wheel 5 is advantageous because it reduces the resistance to pushing of the base unit and improves maneuverability. In FIG. 2, main wheels 5 are shown in both positions to illustrate the different distances between main wheels 5 and front supporting wheels 6.

Figure 3:
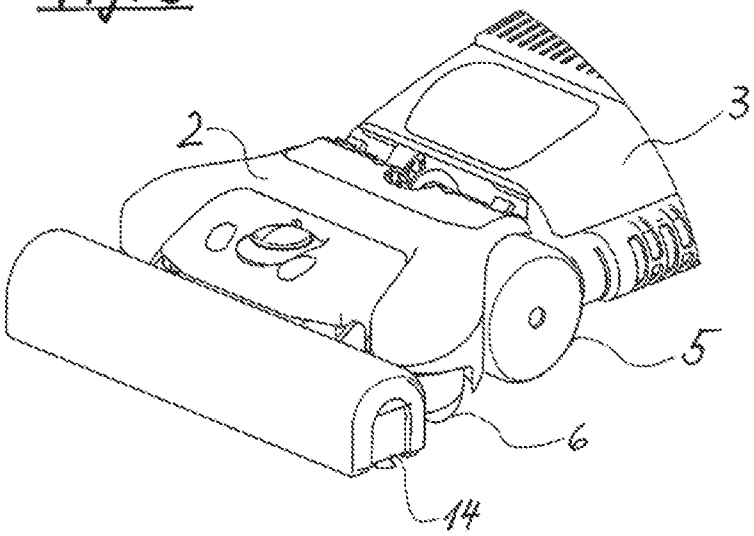
FIG. 3 is a perspective detail view showing the lower portion of the vacuum cleaner in an operating position.
Figure 4:
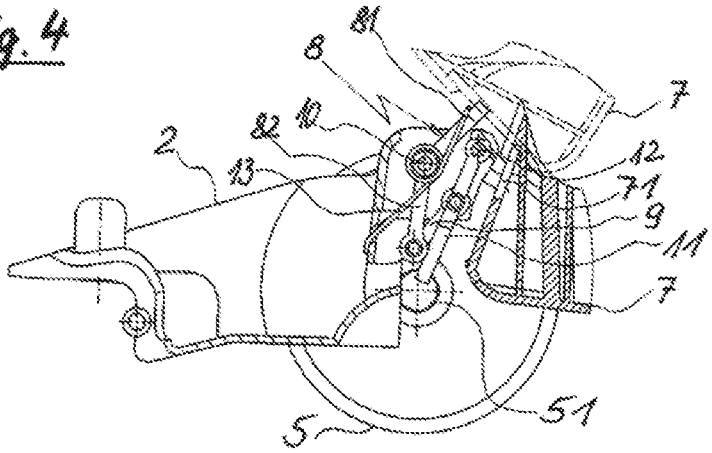
FIG. 4 is a partly sectional detail side view showing the lower portion of the vacuum cleaner in an operating position according to in FIG. 3.
Figure 5:
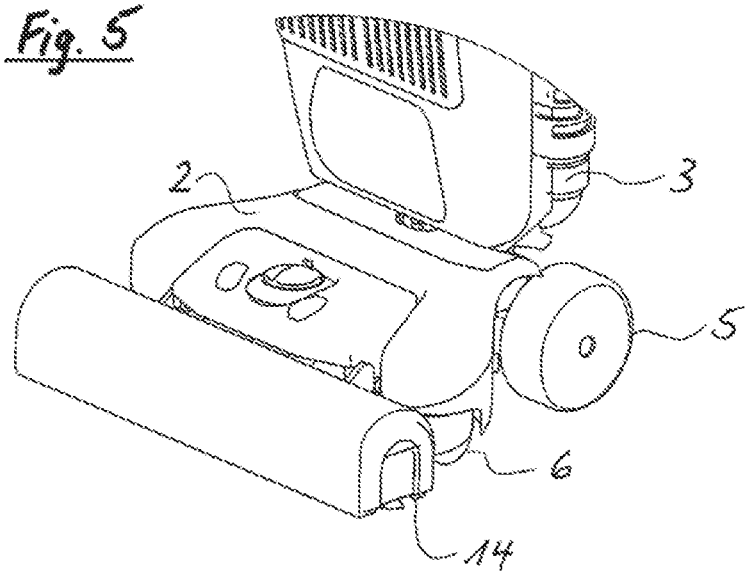
FIG. 5 is a perspective detail view showing the lower portion of the vacuum cleaner in the parked or rest position.
Figure 6:
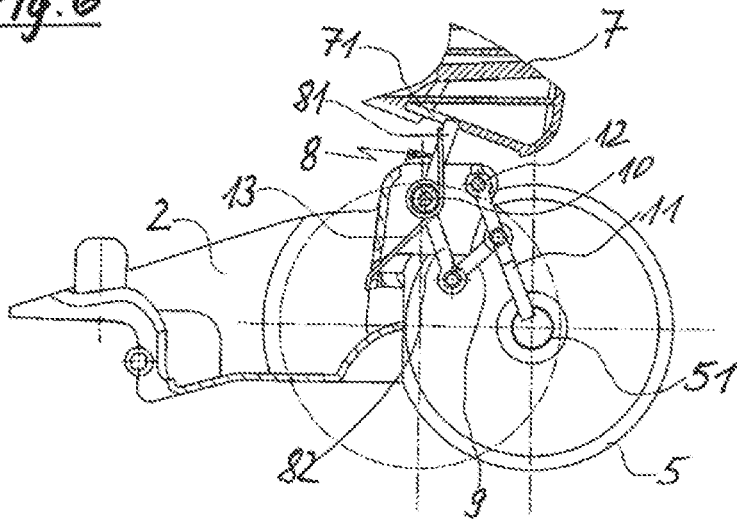
FIG. 6 is a partly sectional detail side view showing the lower portion of the vacuum cleaner in the parked or rest position according to in FIG. 5.

FIGS. 3 and 4 refer to an upright 1 in a possible position during the vacuuming operation, while FIGS. 5 and 6 show upright 1 in the parked position. In accordance with the present invention, the adjusting mechanism disposed between upper body 3 and main wheel 5 is designed in the form of a rugged lever linkage assembly. The design and operation of lever linkage assembly will be easily understood from the exemplary embodiments illustrated in FIG. 4 and FIG. 6.

The main portion of the lever linkage assembly is formed by a drive lever 8, a linking lever 9, and an adjusting lever 11. Drive lever 8 is pivotally mounted to base unit 2 at a fixed bearing point 10. The drive lever includes a lever arm 81 and a lever arm 82, which are oriented at an angle with respect to each other. Lever arm 81 is in operative connection with an actuating element 7 of upper body 3, which will be discussed in greater detail below. Lever arm 82 is pivotally connected to a linking lever 9, which in turn is pivotally connected to adjusting lever 11. Adjusting lever 11 is connected to main wheel 5 or to an axle connecting the main wheels 5 and is capable of moving main wheel or wheels 5 to the parked position in response to a corresponding activation of the lever linkage assembly. Adjusting lever 11 is pivotally mounted at a fixed bearing point 12 provided on base unit 2.

Torsion spring 13 holds drive lever 8 in a biased position, as is apparent from FIG. 4. Torsion spring 13 is push-on mounted on a pin member at bearing point 10 such that one arm of torsion spring 13 acts on lever arm 81 of drive lever 8 and the other spring arm acts on an attachment point formed in base unit 2.

FIGS. 4 and 6 show a portion of upper body 3 which symbolizes the actuating element 7 for moving upright 1 to the parked position. In the example shown here, actuating element 7 has an engagement opening 71 into which lever arm 81 of drive lever 8 cannot engage until upper body 3 is in an upright position.

Actuating element 7 with its engagement opening 71 and drive lever 8 must be arranged in such a way that when upper body 3 is in an upright position of, for example, 70° or more, lever arm 81 can be engaged and carried along by the engagement edge of engagement opening 71 so as to cause main wheels 5 to be pivoted to the parked position.

In the process, the lever linkage assembly functions as follows: In FIG. 4, actuating element 7 is indicated in two positions. In the full-line representation, upper body 3 is in a nearly horizontal position, in which lever arm 81 of drive lever 8 cannot engage into engagement opening 71 of actuating element 7. It is only after upper body 3 has been pivoted to an upright position that lever arm 81 of drive lever 8 can project into engagement opening 71 of actuating element 7, such as is illustrated by the dashed-line representation of actuating element 7 in FIG. 4.

FIG. 6 then shows the parked position of upright 1, which is reached through the action of the lever linkage assembly and in which main wheels are moved rearward. When upper body 3 is pivoted beyond 70°, lever arm 81 of drive lever 8 is carried along and rotated by the engagement edge formed in engagement opening 71 of actuating element 7. The linking lever 9 pivotally connected to lever arm 82 in turn pivots the adjusting lever 11 connected to main wheels 5 or to the axle 51 of main wheels 5, thereby ultimately moving main wheels 5 to the parked position shown in FIG. 6.

Moreover, in this parked position, a locking mechanism (no specifically shown here) is effective to keep upper body 3 of upright 1 locked in this upright position. This locking mechanism can be released by a corresponding actuating element when the vacuuming operation is to be resumed.

The approach using the lever linkage assembly, as proposed by the present invention, enables main wheels 5 to be pivoted rearward by about 40°, allowing upright 1 to stand stably while at rest.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 upright vacuum cleaner (upright)
2 base unit
3 upper body
4 handle
5 main wheel
51 axle
6 caster wheels
7 actuating element on the upper body
71 engagement opening
8 drive lever
81/82 lever arms
9 linking lever
10 bearing point (drive lever)
11 adjusting lever
12 bearing point (adjusting lever)
13 torsion spring
14 suction opening (brush roller)

What is claimed is:

1. An upright-type vacuum cleaner comprising:

an upper body;

a base unit pivotally connected to the upper body, the base unit including a front portion with a suction opening and being equipped with a carriage configured to allow the vacuum cleaner to be moved across surfaces to be cleaned during a vacuuming operation, the carriage including at least one main wheel disposed in a rear portion of the base unit;

a pivot mechanism disposed between the upper body and the base unit, the pivot mechanism being configured to allow the upper body to be pivoted during the vacuuming operation and with the upper body being movable to a substantially upright parked position;

an adjusting mechanism configured to move the main wheel from a first position during vacuuming to a second position in the parked position, the distance from the main wheel to the suction opening being greater in the second position than in the first position during vacuuming, the adjusting mechanism including a lever linkage assembly; and an actuating element formed on the upper body that is configured to engage with the lever linkage assembly as the upper body is moved to the parked position.

2. The upright-type vacuum cleaner as recited in claim 1, wherein the lever linkage assembly is connected to the main wheel so as to move the main wheel from the first position during vacuuming to the second position in the parked position.

3. The upright-type vacuum cleaner as recited in claim 2, wherein the lever linkage assembly includes a drive lever, a linking lever, and an adjusting lever, wherein the drive lever is configured to engage the actuating element of the upper body and is pivotally mounted at a bearing point of the base unit, wherein the adjusting lever is connected to the main wheel or to an axle carrying a plurality of main wheels and is pivotally mounted at a bearing point of the base unit, and wherein the drive lever and the adjusting lever are connected by the linking lever.

4. The upright-type vacuum cleaner as recited in claim 3, wherein the drive lever and the adjusting lever are connected by the linking lever via respective pivoting joints.

5. The upright-type vacuum cleaner as recited in claim 1, wherein the drive lever includes a first lever arm and a second lever arm and is mounted at a bearing point fixedly secured in the base unit such that the drive lever can pivot about a pivot axis located between the two lever arms;

wherein the first lever arm is oriented in such a way that the first lever arm can be brought into engagement with the actuating element by a pivoting movement of the upper body; and wherein the first lever arm is configured to be acted upon by a spring element in such a manner that the main wheel is held in a traveling position for the base unit during the vacuuming operation.

6. The upright-type vacuum cleaner as recited in claim 5, wherein the spring element includes a torsion spring that is push-on mounted on a pin member at a bearing point such that an arm of the torsion spring acts on the first lever arm of the drive lever and another arm of the spring acts on an attachment point formed in the base unit.

7. The upright-type vacuum cleaner as recited in claim 3, wherein the drive lever includes a first lever arm and a second lever arm and is mounted at a bearing point fixedly secured in the base unit such that the drive lever can pivot about a pivot axis located between the two lever arms;

wherein the first lever arm is oriented in such a way that the first lever arm can be brought into engagement with the actuating element by a pivoting movement of the upper body; and wherein the first lever arm is configured to be acted upon by a spring element in such a manner that the main wheel is held in a traveling position for the base unit during the vacuuming operation.

8. The upright-type vacuum cleaner as recited in claim 7, wherein the spring element includes a torsion spring that is push-on mounted on a pin member at a bearing point such that an arm of the torsion spring acts on the first lever arm of the drive lever and another arm of the spring acts on an attachment point formed in the base unit.

9. The upright-type vacuum cleaner as recited in claim 2, wherein the drive lever includes a first lever arm and a second lever arm and is mounted at a bearing point fixedly secured in the base unit such that the drive lever can pivot about a pivot axis located between the two lever arms;

wherein the first lever is oriented in such a way that the first lever arm can be brought into engagement with the actuating element by a pivoting movement of the upper body; and wherein the first lever arm is configured to be acted upon by a spring element in such a manner that the main wheel is held in a traveling position for the base unit during the vacuuming operation.

10. The upright-type vacuum cleaner as recited in claim 9, wherein the spring element includes a torsion spring that is push-on mounted on a pin member at a bearing point such that an arm of the torsion spring acts on the first lever arm of the drive lever and another arm of the spring acts on an attachment point formed in the base unit.

11. The upright-type vacuum cleaner as recited in claim 1, wherein the drive lever includes a first lever arm and a second lever arm and is mounted at a bearing point fixedly secured in the base unit such that the drive lever can pivot about a pivot axis located between the two lever arms;

wherein the first lever arm is oriented in such a way that the first lever arm can be brought into engagement with the actuating element by a pivoting movement of the upper body; and wherein the first lever arm is configured to be acted upon by a spring element in such a manner that the main wheel is held in a traveling position for the base unit during the vacuuming operation.

12. The upright-type vacuum cleaner as recited in claim 11, wherein the spring element includes a torsion spring that is push-on mounted on a pin member at a bearing point such that an arm of the torsion spring acts on the first lever arm of the drive lever and another arm of the spring acts on an attachment point formed in the base unit.

* * * * *